United States Patent [19]

Lavon

[11] 4,195,885

[45] Apr. 1, 1980

[54] METHOD AND DEVICE FOR BREAKING A HARD COMPACT MATERIAL

[75] Inventor: Erik V. Lavon, Harövägen, Sweden

[73] Assignee: Atlas Copco AB, Nacka, Sweden

[21] Appl. No.: 805,520

[22] Filed: Jun. 10, 1977

[30] Foreign Application Priority Data

Jun. 28, 1976 [SE] Sweden ..... 7607337

[51] Int. Cl.[2] ..... E21C 25/60

[52] U.S. Cl. ..... 299/1; 239/101; 299/17

[58] Field of Search ..... 299/17, 1; 173/119, 173/134; 60/537, 591; 239/101

[56] References Cited

U.S. PATENT DOCUMENTS

| | | | |
|---|---|---|---|
| 999,000 | 7/1911 | Trippe | 299/20 |
| 3,412,554 | 11/1968 | Voitsekhovsky | 239/101 UX |
| 3,521,820 | 7/1970 | Cooley | 299/17 X |
| 3,601,987 | 8/1971 | Chermensky | 299/17 |
| 3,605,916 | 9/1971 | Voitsekhovsky | 173/119 |
| 3,687,008 | 8/1977 | Densmore | 91/276 X |
| 3,704,966 | 12/1972 | Beck | 299/17 |
| 3,841,559 | 10/1974 | Hall et al. | 299/17 |
| 3,881,554 | 5/1975 | Cooley | 173/119 |

*Primary Examiner*—William Pate, III

*Attorney, Agent, or Firm*—Frishauf, Holtz, Goodman and Woodward

[57] ABSTRACT

A hard compact material, such as rock, is broken by forcing an elongated mass body of relatively incompressible fluid, such as water, against the material to be broken. The mass body is caused to impact the material at a momentum necessary for breaking the material. The momentum is generated by supplying the fluid to a storage chamber against the effect of a thrust load acting upon the fluid in the storage chamber. When a sufficient amount of fluid has been supplied the fluid in the storage chamber is forced toward the material to be broken by the effect of the thrust load.

39 Claims, 11 Drawing Figures

Fig. 10
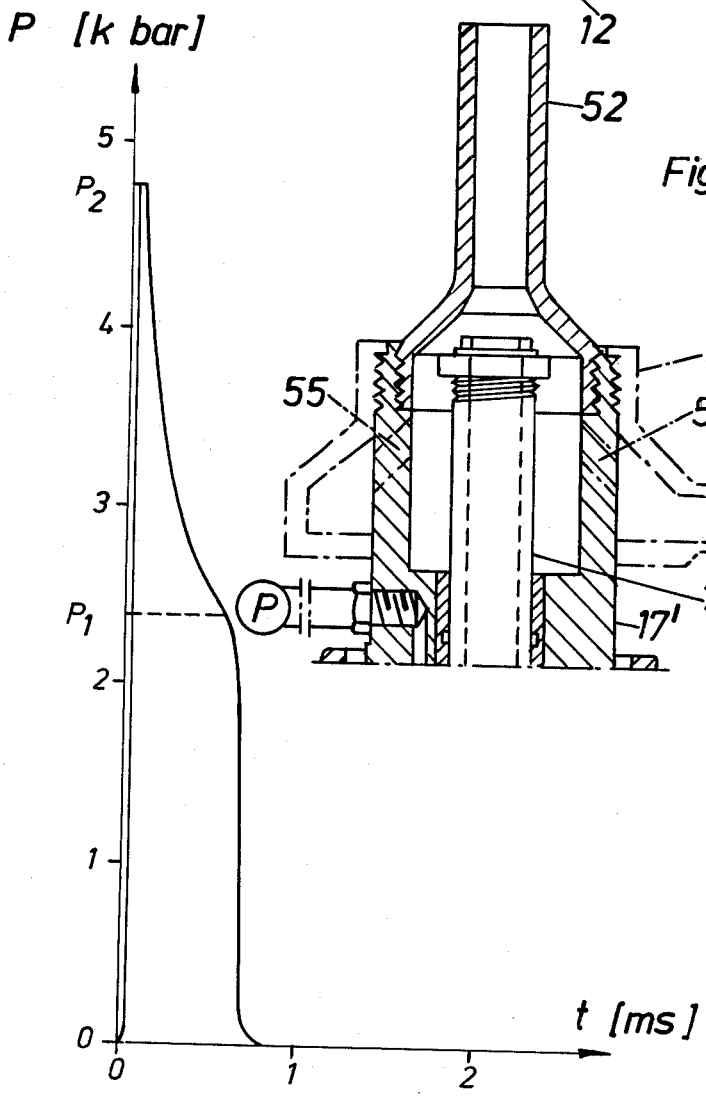
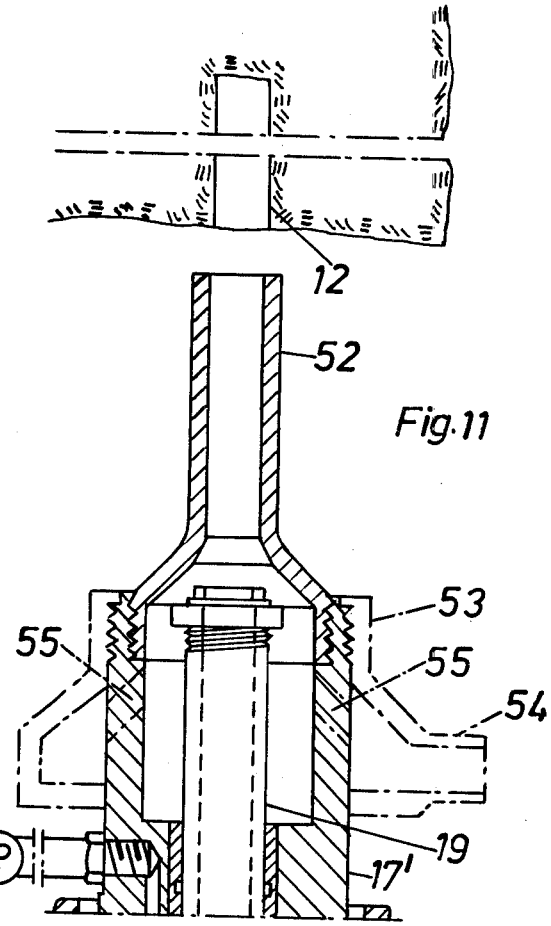
Fig. 11

METHOD AND DEVICE FOR BREAKING A HARD COMPACT MATERIAL

BACKGROUND OF THE INVENTION

This invention relates to breaking of a hard compact material, such as rock.

Conventional methods of rock breakage, including drilling-and-loading-and-blasting and crushing techniques have several disadvantages.

The drill-and-load-and-blast technique has the disadvantage of noise, gases, dust and flying debris, which means that both men and machines must be evacuated from the working area. Crushing techniques require large forces to crush the rock and the tool wear is significant.

During the last decade serious attention has been given to replacing the drill and blast technique for tunneling, mining and similar operations. One alternative technique involves the use of high velocity jets of water or other liquid to fracture the rock or ore body and numerous devices intended to produce pulsed or intermittent liquid jets of sufficiently high velocity to fracture even the hardest rock have been suggested. As yet, however, jet cutting techniques are still unable to compete with the traditional methods of rock breakage such as drill and blast in terms of advance rate, energy consumption or overall cost. Moreover, serious technical problems such as the fatigue of parts subjected to pressures as high as 10 or 20 kbar and excessive operational noise remain.

A second, and even older technique for fracturing the rock and for saturating soft rock formations such as coal with water for dust suppression involves drilling a hole in the rock and thereafter pressurizing the hole with water either statically or dynamically.

These methods are inapplicable to hard rock formations because of the restriction in working pressure which can be realized or usefully utilized with conventional hydraulic pumps. They are difficult to apply in practice particularly in soft crumbling rock or badly fissured rock in that the bore hole must be effectively sealed around the tube introduced into the hole through which the liquid is pumped. These restrictions in all make the method far less versatile than drill and blast.

In applicant's Swedish patent specification 7510559-3 (corresponding to U.S. application Ser. No. 720,122, filed Sept. 3, 1976) a hydraulic breaking technique is described which makes it possible to break hard compact material such as rock by using equipment which operates at comparatively low pressures.

SUMMARY OF THE INVENTION

An object of the present invention is to provide an improvement in the breaking technique shown in Swedish patent application 7510559-3.

According to the present invention a method and device is provided wherein the momentum, i.e. the product of the mass of the fluid body and its velocity, which is necessary for breaking, is generated by supplying the fluid to a storage chamber against the action of a thrust load, whereupon the fluid in the storage chamber is forced or driven against the material by the effect of the thrust load.

Another object is to provide a device where the forcing or launching of the fluid is controlled by the fluid itself.

A further object is to provide a gun of the repeater-type for launching rapid series of "shots".

BRIEF DESCRIPTION OF THE DRAWINGS

The invention is described in the following description with reference to the accompanying drawings in which two embodiments are shown by way of example. It is to be understood that these embodiments are only illustrative of the invention and that various modifications thereof may be made within the scope of the claims following hereinafter.

In the drawings,

FIG. 10 is an illustration of the pressure time history of the pressure in a simulated drill hole.

FIG. 11 shows a modification of the embodiment according to FIGS. 1–5.

DETAILED DESCRIPTION OF ILLUSTRATED EMBODIMENTS

Figure 1:
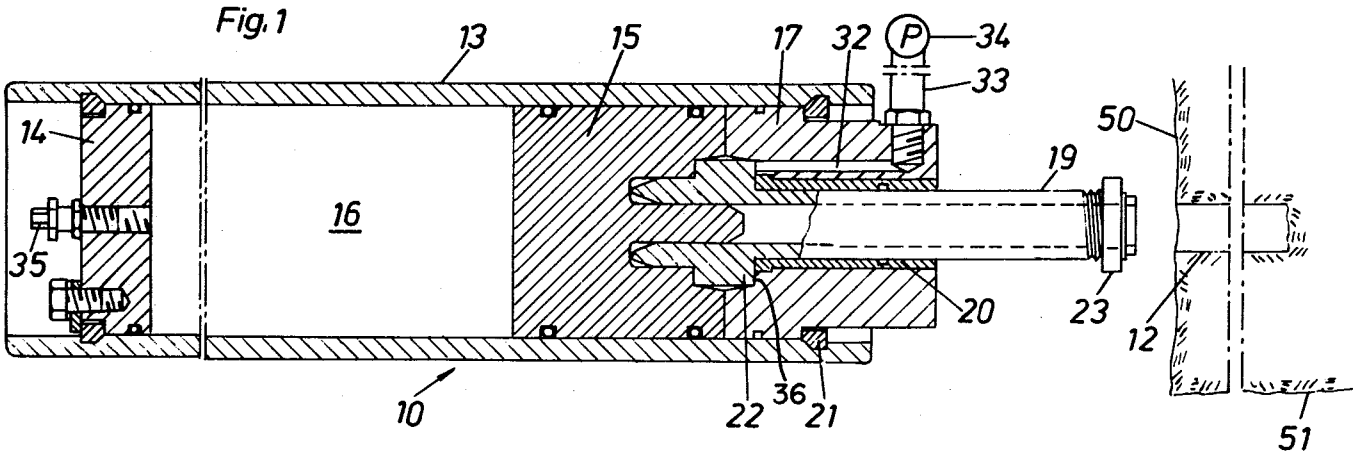
FIGS. 1–5 show in section a side view of a device according to the invention during different phases of operation.
Figure 2:
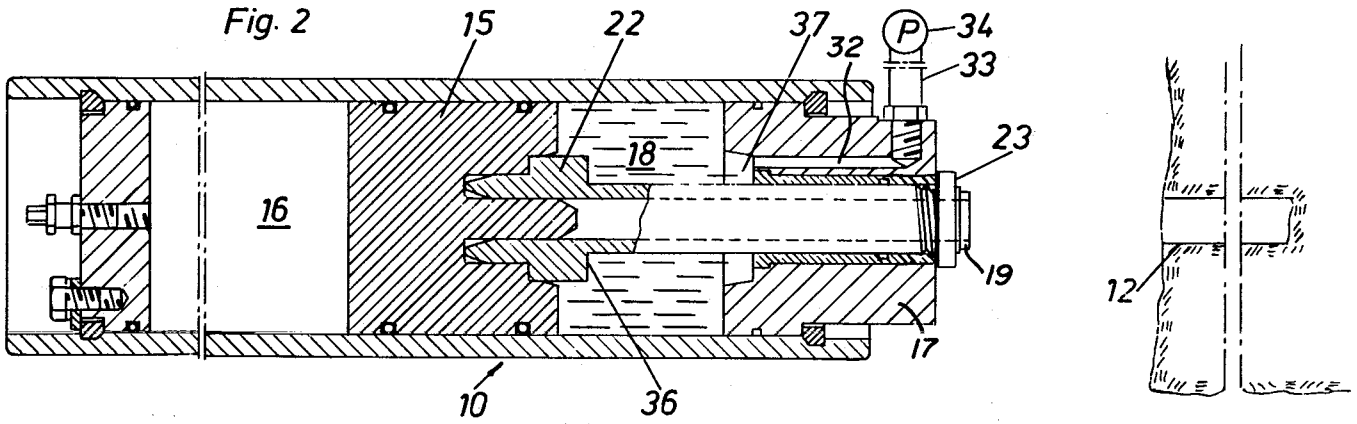

Corresponding details have been given the same reference numeral in the various figures.

In FIGS. 1–5 is shown a gun generally depicted 10 for launching fluid in the form of a fluid piston or column 11 into a cylindrical blind hole 12, which is predrilled in the material to be broken. As examples of materials breakable according to the invention can be mentioned rock, metal ores, concrete and coal. The blind hole 12 is drilled using a conventional technique. In the illustrated embodiment the fluid piston consists of water other fluids, however, may be used.

The gun 10 comprises a cylinder 13 which at its rear end is closed by means of a back head 14. A drive piston 15 is reciprocable within the cylinder 13. The drive piston 15 and the back head 14 confine a rear cylinder chamber 16.

A front head 17 is mounted in the forward end of the cylinder 13. The front head 17 is prevented from being pushed out of the cylinder by a lock ring 21 which comprises several segments. The drive piston 15 and the front head 17 confine a forward cylinder chamber 18 (FIGS. 2–5.) A barrel 19 is reciprocably guided in a bushing 20 which is inserted in the front head 17. The movement of the barrel 19 is limited by a rear enlarged portion 22 on the barrel and by a stop ring 23 screwed on the forward end of the barrel.

Figure 4:
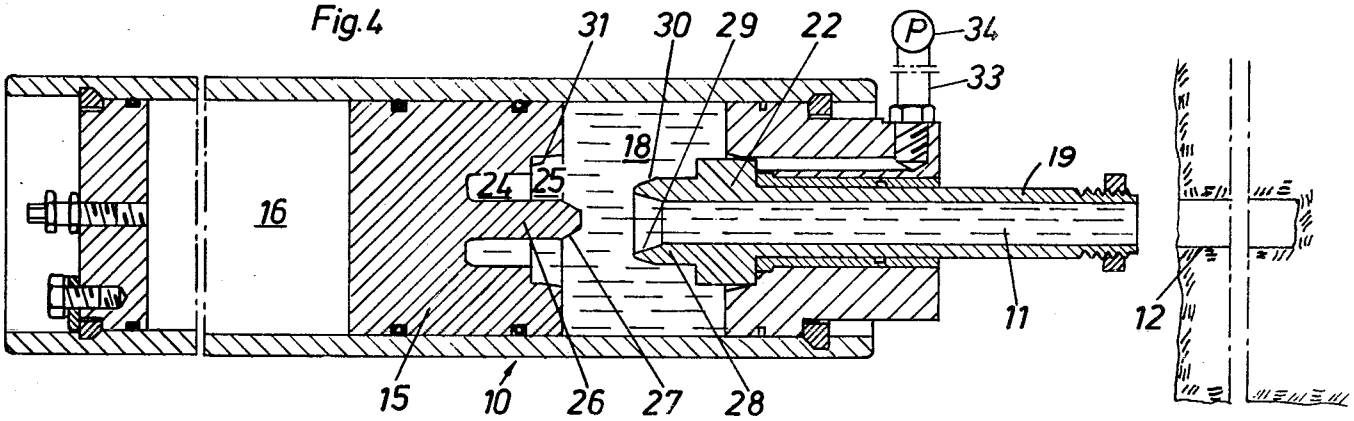

The side of the drive piston 15 which faces the forward cylinder chamber 18 is provided with an annular stepped recess. As seen in FIG. 4, the annular stepped recess comprises an inner annular chamber 24 and an outer annular chamber 25 having larger outer diameter. The annular recess 24, 25 surrounds a central pin 26. At its forward end the pin 26 has a bevelled side surface 27. The portion 28 of the barrel which projects rearward from the enlarged portion 22 has at its rear end bevelled inner and outer side surfaces 29, 30. The enlarged portion 22 can be pushed into the chamber 25 to rest against an annular surface 31 while at the same time the rear barrel portion 28 is pushed into the chamber 24.

The forward cylinder chamber 18 provides a storage chamber for the fluid before the fluid is admitted into the barrel 19. The fluid is supplied to the storage chamber 18 through a passage 32 (see FIGS. 1 and 2) which is connected to a high pressure pump 34 via a hose 33.

The forward cylinder chamber 18 is provided with an annular chamber 37. The chamber 37 works as a retard chamber for the enlarged portion 22 so that the barrel 19 is retarded hydraulically during the end of its movement forwards.

The rear cylinder chamber 16 is charged with compressed gas, such as pressure air or nitrogen. The compressed gas acts upon the drive piston 15 which transmits this thrust load to the fluid in the storage chamber 18. The rear cylinder chamber 16 can be connected to a pressure source, such as a compressor, by means of a connection nipple 35 in the back head 14.

The gun shown in FIGS. 1–5 operates as follows:

In FIG. 1 the drive piston 15 and the barrel 19 are shown in their position when the barrel is directed toward a hole 12.

Figure 3:
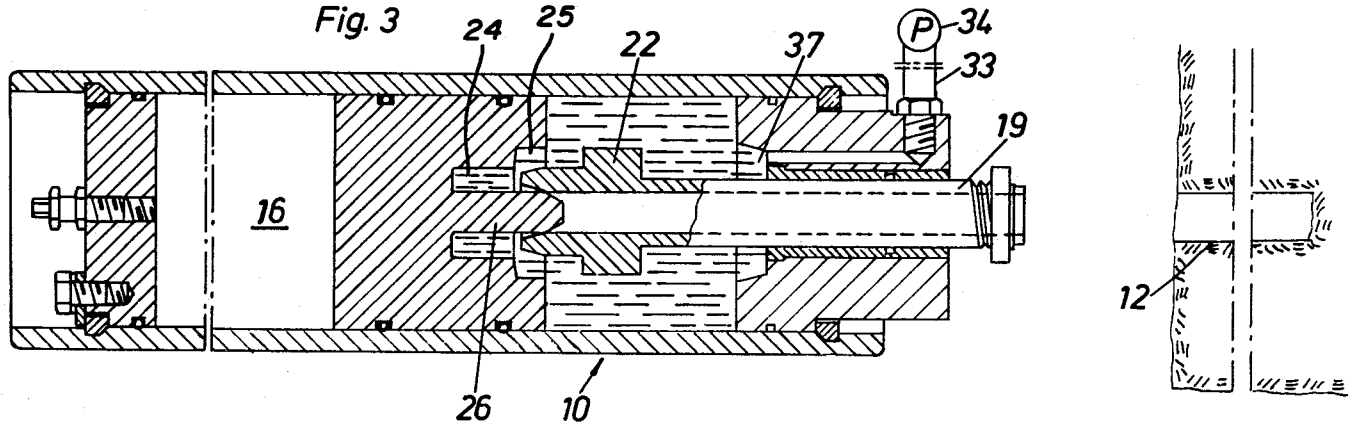

Upon completion of the adjustment of the position of barrel 19, the pump 34 is started, whereupon the fluid is supplied to the passage 32. The fluid pressure acts upon an annular surface 36, see FIG. 2, on the enlarged portion 22. The barrel 19 and the drive piston 15 are then forced backwards against the action of the gas spring in the rear cylinder chamber 16, i.e. the fluid is successively supplied to the storage chamber 18 against the effect of the thrust load acting upon the fluid in the storage chamber 18. After a short displacement the enlarged portion 22 leaves the retard chamber 37 which means that the fluid pressure also acts directly upon the drive piston 15. The barrel 19 and the drive piston 15 are pushed backwards during compression of the gas in the rear cylinder chamber 16 thereby storing energy in the gas in rear chamber 16. When the stop ring 23 is retarded against the front head 17 the barrel 19 is locked against a continued backward movement, FIG. 2. The drive piston 15 is now pushed backwards alone. When the enlarged portion 22 leaves the chamber 25 (FIG. 3) fluid is allowed to flow therein. Shortly afterwards the rear portion 28 of the barrel leaves the chamber 24, whereupon fluid also flows into this chamber. The fluid, however, is prevented from being admitted into the barrel due to the pin 26 which still closes the barrel (FIG. 3.) When the fluid is admitted into the chamber 24 the barrel 19 is forced forwards. After a short movement of the barrel the pin 26 leaves the bore of the barrel. FIG. 3 shows the position where the admission of fluid into the barrel is just to be started.

The barrel 19 is now rapidly driven forwards and is retarded when the enlarged portion 22 reaches the retard chamber 37, FIG. 4. Thus, the fluid is forced through the barrel 19 due to the thrust load acting upon the fluid in the storage chamber 18. In the barrel 19 the fluid is formed as a fluid piston 11. The fluid piston is accelerated as a coherent elongated mass body and is directed and launched into the hole 12 to impact the bottom of the hole. As the fluid leaves storage chamber 18, the drive piston also moves forwards under the influence of the thrust load provided by the gas in rear cylinder chamber 16.

Figure 5:
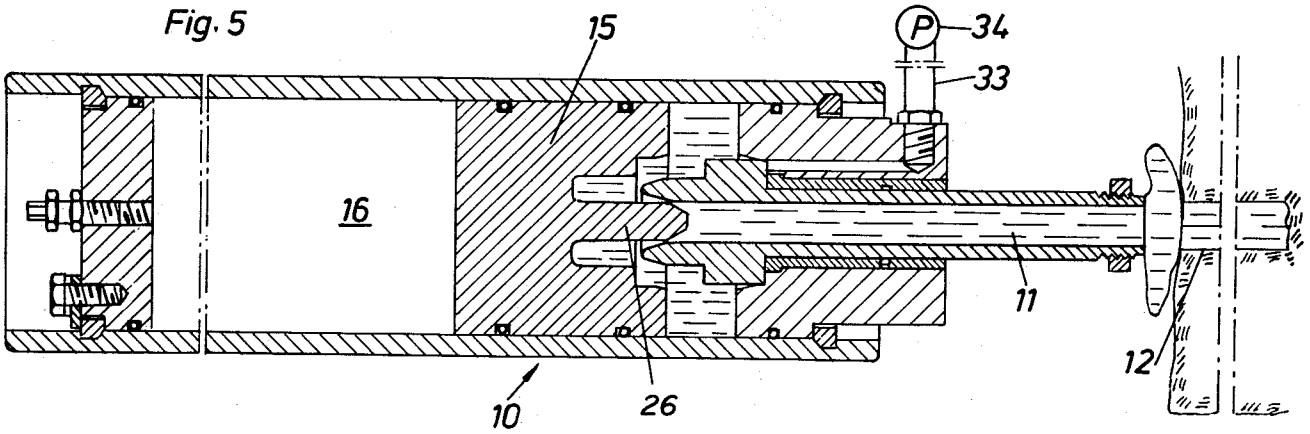

FIG. 5 shows the position where the pin 26 reaches the bore of the barrel which means that the retardation of the drive piston 15 is started. The remaining fluid in the cylinder chamber 18 is used to hydraulically retard the drive piston 15. In order to prevent rebounce of the drive piston 15 the remaining fluid has to be forced through the annular clearance between the pin 26 and the bore of the barrel 19 via the annular chambers 24, 25. By suitable dimensioning of the annular clearance relative to the energy stored in the drive piston and to the amount of remaining fluid in the cylinder chamber 18 and the annular chambers 24, 25 the drive piston is retarded gently. FIG. 1 shows the final position after a "shot".

The clearance between the barrel 19 and the drive piston 15 is of great importance to the operation of the gun. In order to obtain the above described function the clearance between the bevelled surfaces 27, 29 (FIG. 4) on the pin 26 and the barrel, respectively, has to be smaller than the clearance between the bevelled surface 30 on the barrel and the outer surface of the annular chamber 24. The latter clearance in turn has to be smaller than the clearance between the enlarged portion 22 and the outer surface of the annular chamber 25. By this is obtained a continuously increasing restriction of the fluid in its direction of flow.

By making the clearance between the pin 26 and the bore of the barrel 19 larger, for instance by making the pin 26 shorter, the gun can be designed to launch two "shots", the second following immediately after the first one. This is caused by the fact that the drive piston 15 reaches the barrel 19 before the barrel is retarded in the retard chamber 37. When reaching the barrel the drive piston delivers an impact thereto so that the drive piston and the barrel once again are separated.

The gun can be designed as a gun of the repeater-type by connecting the hose 33 to a continuously operating pump. When the barrel 19 and the drive piston 15 reach the position shown in FIG, 2 the next pump stroke produces the "shot". The pump continues to operate until the next "shot" is fired and so on. Consequently, a series of "shots", the next following shortly after the preceding one, is fired into the hole. The first "shot" may produce cracks when it impacts the hole bottom whereupon the following "shots" drive the cracks until they reach a free surface of the material; the surface 50 when breaking according to the crater blasting mode or the surface 51 when breaking according to the bench blasting mode, see FIG. 1. It should be stressed that the series of "shots" are fired automatically as long as the pump operates, thus without any intervention of the operator.

The amount of launched fluid can easily be varied by means of the stop ring 23 which defines the rear turning position of the barrel 19.

In FIG. 11 is shown a modified front part of the embodiment according to FIGS. 1–5. The front head $17^1$ extends forwards to about the outermost position of the barrel 19. An extension barrel 52 is screwed to the extended front head $17^1$. The inner diameter of the extension barrel 52 is substantially the same as that of the barrel 19. The extension barrel 52 facilitates aligning of the gun with the hole 12 and serves as a guard to protect the movable barrel 19 against mechanical damage by preventing the barrel 19 from abutting the rock.

In cases where the hole 12 has a tendency to be waterfilled it may be desired to evacuate the hole before shooting. For that purpose a hood 53 shown in chain lines in FIG. 11 can be screwed on the front head $17^1$. Pressure air is admitted into the hood 53 through an inlet 54 and is blown into the hole 12 via passages 55 in the front head $17^1$ and the extension barrel 52.

Figure 6:
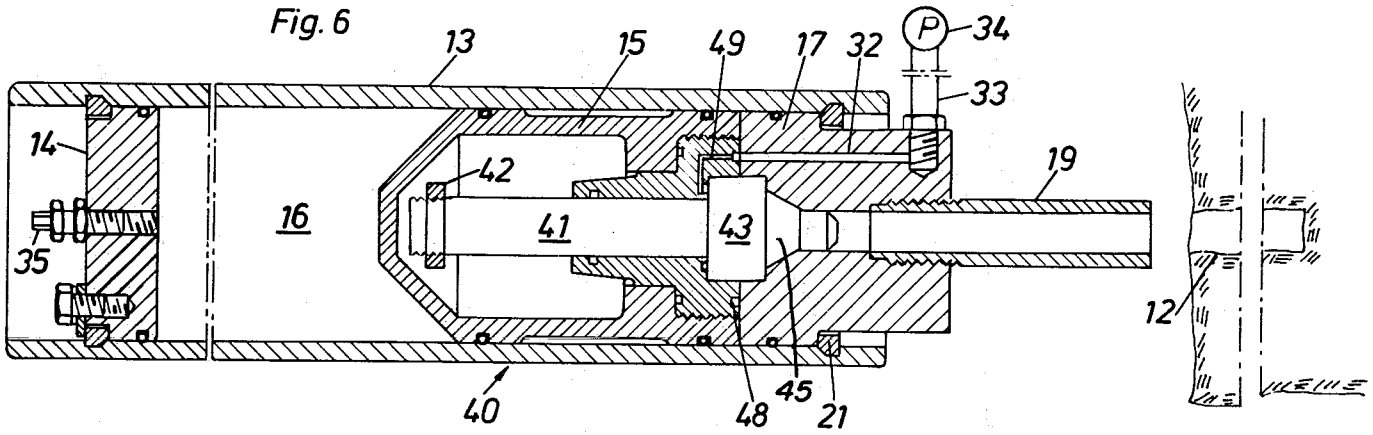
FIGS. 6–9 show in section a side view of another embodiment according to the invention during different phases of operation.
Figure 7:
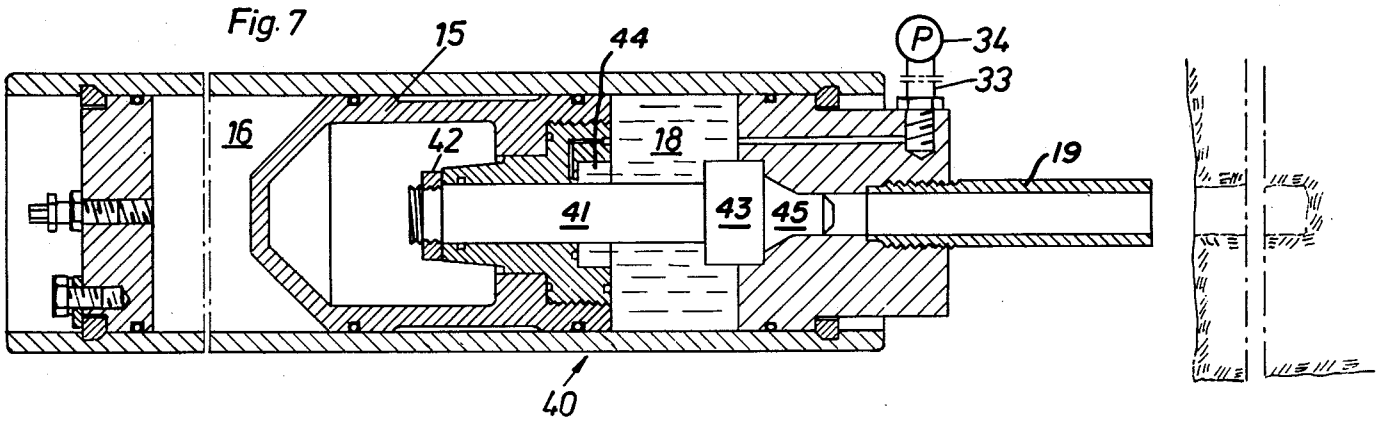
Figure 8:
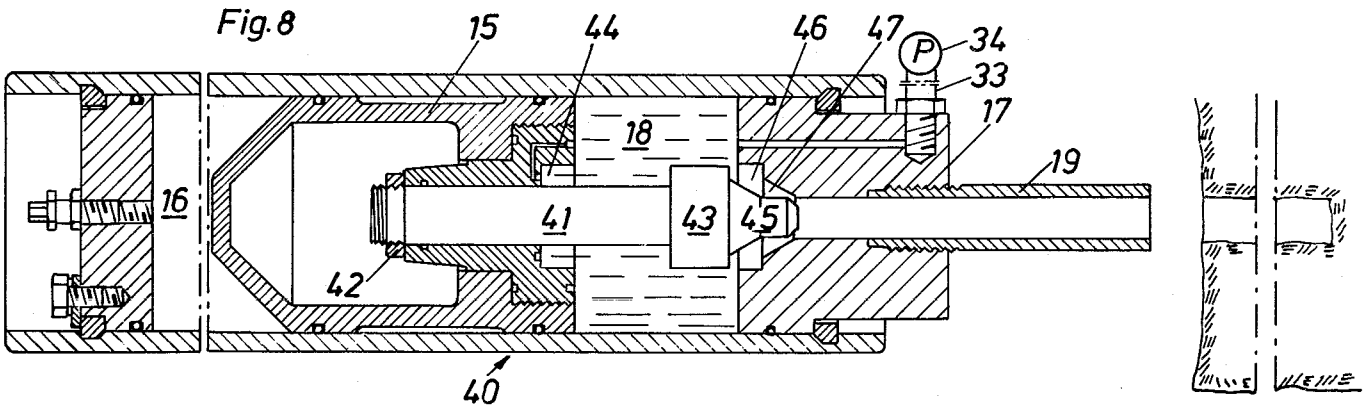
Figure 9:
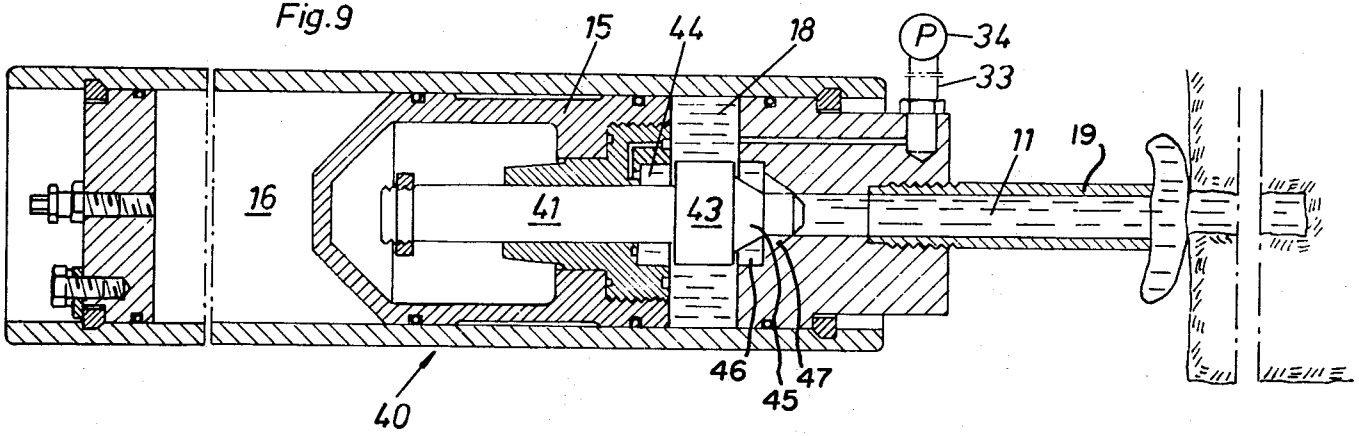

In the embodiment of the gun shown in FIGS. 6–9, generally depicted 40, the barrel 19 is firmly connected to the front head 17. A rod 41 is displaceably guided relative to the drive piston 15. The relative displacement between the rod 41 and the drive piston 15 is limited by a stop ring 42 screwed on the rod 41 and an enlarged portion 43 on the rod 41. The drive piston 15 is provided with an annular chamber 44 (FIGS. 7–9) which is dimensioned for receiving the enlarged portion 43. A pin 45 projects from the enlarged portion 43. The front head 17 is provided with a recess which corresponds to the enlarged portion 43 and the pin 45 and which recess comprises an annular chamber 46 and a conical chamber 47 (FIGS. 8 and 9).

The gun shown in FIGS. 6–9 operates as follows:

In FIG. 6 the drive piston 15 and the rod 41 are shown in their position during the adjustment of the barrel 19 to alignment with the hole 12. Upon completion of the adjustment the position of the barrel 19, the pump 34 is started, whereupon the fluid is admitted into the passage 32. The fluid pressure is distributed uniformly over the surface of the drive piston 15 by means of an annular groove 48. After a short displacement of the drive piston 15 the fluid pressure is caused to act upon the entire area of the drive piston 15. During successive fluid admission the drive piston 15 is forced backwards against the action of the thrust load caused by the gas spring 16. In order to safeguard that the rod 41 remains in the position shown in FIG. 6 the fluid pressure is transferred through a passage 49 to act upon a rear ring surface on the enlarged portion 43 of the rod 41.

When the drive piston 15 reaches the stop ring 42, FIG. 7, continued fluid supply will cause the portions 43, 45 of the rod 41 to be drawn out of the recess 46, 47 in the front head 17, FIG. 8. Then the thrust load acting upon the fluid in the storage chamber 18 forces the fluid through the barrel 19 via the chambers 46, 47. The rod 41 remains in its position shown in FIG. 8 due to the pressure difference over the portion 43.

FIG. 9 shows the position where the drive piston 15 reaches the enlarged portion 43 of the rod 41. The drive piston 15 is retarded hydraulically by the fluid in the retard chamber 44 and by the remaining fluid in the storage chamber 18. In order to obtain a gentle retardation of the drive piston 15 and prevent rebounce thereof the clearance between the annular chamber 44 and the enlarged portion 43 should be larger than the clearance between the portion 43 and the annular chamber 46. This latter clerance in turn should be larger than the clearance between the cylindrical front end of the pin 45 and the bore of the barrel. By this is achieved a continuously increasing restriction of the fluid flow in its direction of flow.

When required, the volume enclosed in the drive piston 15 my be drained through a passage, not shown, in the rod 41. Alternatively the drive piston 15 may be designed without this hollow. In this case the pressure gas acts upon the drive piston as well as against the rod 41.

In applicant's Swedish patent specification 7510559-3 there are stated conditions which must be met in order to obtain accurate breakage. This theory, however, does not consider the effect caused by compression of the air volume enclosed between the fluid column and the bottom of the hole. In order to look into this effect the pressure in a simulated drill hole has been studied. In FIG. 10 a pressure vs. time diagram is illustrated. Water in the mass body was forced into a 500 mm deep solid iron tube an elongated 23 mm diameter. The bottom of the tube was closed. A gun of the type shown in FIGS. 1–5 was used. When the fluid column impacted the bottom of the tube the overall length of the fluid column was about 800 mm. The impact velocity against the bottom was about 170 m/sec. The ratio between the diameter of the pipe and the inner diameter of the tube was 0.956. The so-called liquid impact pressure, i.e. $p=\rho CV$ where $\rho$ is the density of the liquid, C is the speed of sound in the liquid and V is the velocity of the liquid when it strikes the bottom of the hole, which is generated in the bottom of the hole becomes about 2.4 kbar, $P_1$ in FIG. 10. As shown in FIG. 10 the actual pressure is higher than this liquid impact pressure. This difference is probably caused by the explosive exansion of the air volume which is compressed by the water column in the tube. High speed filming of the process indicates that the compressed air is taken up and distributed in the water column when the column strikes the bottom of the hole. The expansion energy of the compressed air is superposed on the energy stored in the water column. Thus it is evident that a possible compression of the enclosed air volume in a drill hole affects the breaking process favorably, particularly concerning the generating of cracks which are required for the breaking. In the pressure vs. time curve illustrated in FIG. 10 the tube was so strong that it was not broken when the water stroke against its bottom. In practice the pressure diagram is more complicated. Particularly, the occurrence of natural cracks in the material decreases and sometimes substantially completely eliminates the effect of the compression of the air. Further, this effect is decreased by a smaller relative area ratio between fluid column and hole.

In Swedish patent specification 7510559-3 is described how the propagation of cracks may be caused to take precedence in different directions in order to achieve a directed fracture or break effect. The gun described in this application can to advantage be mounted together with a conventional rock drilling machine on a rig of the type described in Swedish patent specification 7510559-3. In such a rig the gun and the rock drilling machine can be arranged movably on the feed bar in the latitudinal direction thereof or turnably about an axis which is parallel with the feed bar.

Several experiments have been made with the abovedescribed devices. For example blocks of limestone and granite, in size of about 1 m×1 m×1 m, have been broken by means of the gun shown in FIGS. 1–5. A 500 mm deep blind hole with 23 mm diameter was drilled in the blocks. The length of the barrel was 300 mm. A coherent water column having a length of about 800 mm was forced or driven against the bottom of the hole. The impact velocity of the water column was about 170 m/sec and its kinetic energy about 6 kilojoule. Depending on the orientation of the holes with respect to inhomogeneities in the blocks, these blocks were broken completely after a varying numer of "shots", generally 1 to 3. If the cracks which are generated by the first "shot" did not reach a free surface, following "shots" did cause the cracks to be driven further.

In the illustrated embodiments the fluid piston or column is forced into a pre-drilled hole. This mode of operation has the best efficiency. However, sometimes breaking can be carried out without these holes. In such cases the gun preferably should be directed in a suitable manner relative to the configuration of the material. This mode of operation, however, makes greater demands upon the skill of the operator.

Alternatively the admission of fluid into the barrel from the storage chamber can be controlled by means of a conventional valve provided with an individual control circuit.

In another alternative embodiment the fluid admission into the barrel is regulated by means of a valve means which is controlled by the pressure in the storage chamber in such a way that the valve means is put out of operation when the pressure exceeds a certain value. Such valve means may be a burst plate which is burst by the pressure. Particularly the valve means may consist of a capsule containing an explosive.

The method of generating a momentum in a fluid according to the invention is generally applicable and can therefor be used also in other equipment for generating high velocity jets of fluid.

What I claim is:

1. A method of breaking hard compact material, such as rock by means of relatively incompressible fluid, such as water, which as an elongated fluid mass body (11) is directed toward the material to be broken, comprising:

storing a mass of said fluid in a storage chamber (18), exerting a substantially continuous thrust load upon the fluid in said storage chamber (18), successively supplying said fluid to said storage chamber (18) against the effect of said thrust load, providing a barrel (19) coupled to said storage chamber for forming fluid received from said storage chamber into an elongated coherent mass body (11) and for directing the fluid mass body (11) toward the material to be broken, and suddenly opening a passage between said storage chamber and said barrel, responsive to a predetermined amount of the fluid being supplied to said storage chamber (18), to permit said fluid in said storage chamber (18) to be expelled through said barrel as said elongate mass body and toward the material to be broken by the effect of said thrust load exerted on said fluid, the maximum pressure in said storage chamber during said expelling of fluid from said storage chamber being substantially the same as the maximum pressure during the supplying of fluid to said storage chamber.

2. A method according to claim 1 comprising adjusting said valve means (22,28) by moving the barrel means (19) in the direction of acceleration of the fluid, said barrel comprising a tubular slide valve.

3. A method according to claim 1, wherein the fluid is accelerated in the form of a water column to a velocity in the order of about 100 to 300 meters/sec.

4. A method according to claim 3, wherein the water column has a length of about 0.2 to 2.0 meters.

5. A device for breaking a hard compact material, such as rock, wherein the material is broken by means of relatively incompressible fluid, such as water, which as an elongated fluid mass body (11) is directed toward the material to be broken, comprising:

a storage chamber (18) for storing the fluid, means (15,16) operatively associated with said storage chamber (18) for substantially continuously exerting a thrust load upon the fluid in said storage chamber (18), means for successive supply of said fluid to said storage chamber (18) against the effect of said thrust load, a barrel (19) coupled to said storage chamber (18) for forming fluid received from said storage chamber into an elongated coherent mass body (11) and for directing the fluid mass body (11) toward the material to be broken, and valve means (22,28; 43,45) coupled between said storage chamber and said barrel, and means for causing said valve means to suddenly open a passage between said storage chamber and said barrel, to permit the fluid from said storage chamber to be expelled through said barrel as said elongate mass body, the maximum pressure in said storage chamber during said expelling of fluid from said storage chamber being substantially the same as the maximum pressure during the supplying of fluid to said storage chamber.

6. A device according to claim 5, wherein said means for exerting a thrust load includes a drive piston (15) acting upon the fluid in said storage chamber (18).

7. A device according to claim 6, wherein the fluid in said storage chamber (18) is adapted to hydraulically retard said drive piston (15) during the end of a work stroke thereof.

8. A device according to claim 6, wherein said barrel (19) is movable relative to the storage chamber in the driving direction of the fluid mass body.

9. A device according to claim 8, wherein said movable barrel (19) comprises a tubular slide valve for controlling the admission of fluid into said barrel.

10. A device according to claim 6, wherein said drive piston (15) and barrel (19) are adapted to be moved together in a backward direction opposite to the working direction of the drive piston (15) during the supply of fluid to said storage chamber (18), and wherein said drive piston (15) is provided with sealing means for fluidtight cooperation with the barrel (19) during said simultaneous movement of the drive piston (15) and the barrel (19) in said backward direction.

11. A device according to claim 10, wherein said barrel (19) is provided with a stop means (23) adapted to limit the backward movement of the barrel.

12. A device according to claim 11, wherein said stop means (23) is axially adjustable relative to the barrel (19) for permitting adjustment of the amount of fluid supplied to said storage chamber (18).

13. A device according to claim 5, wherein said elongated fluid mass body (11) is directed toward a predrilled hole (12) in the material, and wherein said fluid mass body is formed to substantially fill the free cross sectional area of the hole (12).

14. A device according to claim 5, wherein said elongated fluid mass body is of water, has a length of about 0.2 to 2.0 meters and is given an impact velocity against the material in the order of about 100 to 300 meters/sec. by means of the thrust load.

15. A device according to claim 5, comprising retardation means (26,22; 43,44) for retarding said thrust load exerting means (15) after the momentum has been generated in said fluid mass body.

16. A device according to claim, 6 wherein said barel (19) is movable relative to the storage chamber in the driving direction of the fluid mass body.

17. A device according to claim 6, wherein said storage chamber (18) has an outlet opening, and said drive piston (15) in a predetermined rear position is adapted to uncover said outlet opening in said storage chamber, said drive piston comprising a part of said valve means.

18. A device according to claim 17, wherein said drive piston (15) controls operation of said valve means (43,45) by applying a force thereagainst.

19. A device according to claim 6 wherein said drive piston (15) has an internal cavity therein.

20. A device according to claim 5, wherein said means for causing said valve means to suddenly open comprises means responsive to a predetermined amount of fluid being supplied to said storage chamber for causing said valve means to suddenly open when a predetermined amounted of fluid has been supplied.

21. A device according to claim 8, wherein the barrel (19) includes means cooperating with the fluid in the storage chamber so as to be retarded hydraulically by the fluid in the storage chamber (18).

22. A device for breaking a hard compact material, such as rock, wherein the material is broken by means of relatively incompressible fluid, such as water, which as an elongated fluid mass body (11) is directed toward the material to be broken, comprising:

a storage chamber (18) for storing the fluid, means including a drive piston (15) operatively associated with said storage chamber (18) for exerting a thrust load upon the fluid in said storage chamber (18), said drive piston (15) acting upon the fluid in said storage chamber (18), means for successive supply of said fluid to said storage chamber (18) against the effect of said thrust load, a barrel (19) coupled to said storage chamber (18) for forming fluid received from said storage chamber into an elongated coherent mass body (11) and for directing the fluid mass body (11) toward the material to be broken, and means responsive to a predetermined amount of the fluid being supplied to said storage chamber (18) to permit said fluid in said storage chamber (18) to be forced into said barrel (19) and toward the material to be broken by the effect of said thrust load exerted on said fluid and said means responsive to a predetermined amount of fluid being supplied to said storage chamber including adjustable valve means (22,28; 43,45) for controlling the admission of fluid into said barrel (19) from said storage chamber (18), said valve means being controlled by means of said drive piston (15).

23. A device according to claim 22, wherein said valve means, is of the type and comprises a rod (41) which projects backwards from the barrel (19), said rod (41) being provided with a limit stop (42) and said drive piston (15) being provided with an abutment surface, said limit stop 42 and abutment surface being adapted to cooperate after a short movement of the drive piston (15) in order to cause said valve means to lift from its seat, said short movement of the drive piston being caused by the admission of fluid to said storage chamber (18).

24. A device according to claim 23, werein said drive piston (15) has an internal cavity therein, said rod (41) passing into said internal cavity and being slidable relative to said drive piston (15).

25. A method of breaking hard compact material such as rock, by means of relatively incompressible fluid, such as water, comprising:

causing an elongated mass body (11) of the fluid to impact the material to be broken at such momentum that the material is broken, supplying fluid to a storage chamber (18) which has a movable rear partition wall (15) upon which acts a thrust load, maintaining a passage between said storage chamber and a barrel means (19) closed during the fluid supply, said barrel means being adapted to direct the fluid toward the material, and opening said passage by means of said movable rear partition wall (15) in a predetermined rear position thereof upon the supply of a predetermined amount of fluid to said storage chamber, thereby generating the momentum in a substantially non-impact manner which is required for breakage.

26. A method according to claim 25 comprising directing said elongated mass body (11) of fluid into a pre-drilled hole (12) in said material to be broken for impacting a surface therein, and forming by means of said barrel means said elongated mass body of fluid so that the cross sectional area thereof substantially fills the free cross sectional area of said pre-drilled hole (12).

27. A method according to claim 26, wherein the fluid is accelerated in the form of a water column to a velocity in the order of about 100 to 300 meters/sec.

28. A method according to claim 27, wherein the water column has a length of about 0.2 to 2.0 meters.

29. A method of breaking hard compact material, such as rock, by means of relatively incompressible fluid, such as water, comprising:

causing an elongated mass body (11) of the fluid to impact the material to be broken at such momentum that the material is broken, generating the momentum which is required for breakage by first successively supplying fluid to a storage chamber (18) against the effect of a thrust load acting upon the fluid in the storage chamber, and when a sufficient amount of fluid has been admitted into the storage chamber, controlling, by the fluid supply to the storage chamber (18), a valve means (22, 28; 43, 45) which controls the admission of fluid from the storage chamber (18) into a barrel means (19) which directs the fluid toward the material, thereby forcing in a non-impact manner the fluid in the storage chamber toward the material to be broken by the effect of said thrust load, said barrel means comprising a tubular slide valve, the rearward end of which comprises said valve means, said valve means being controlled by moving said barrel means forwards in the direction of acceleration of the fluid under the influence of the fluid in the storage chamber.

30. A method according to claim 29, wherein the fluid is accelerated in the form of a water column to a velocity in the order of about 100 to 300 meters/sec.

31. A method according to claim 30, wherein the water column has a length of about 0.2 to 2.0 meters.

32. A device for breaking a hard compact material, such as rock, wherein the material is broken by means of relatively incompressible fluid, such as water, which is an elongated fluid mass body (11) is directed toward the material to be broken, comprising:

a storage chamber (18) for storing the fluid, means (15,16) operatively associated with said storage chamber (18) for exerting a thrust load upon the fluid in said storage chamber (18), means for successive supply of said fluid to said storage chamber (18) against the effect of said thrust load, a barrel (19) slideably coupled to said storage chamber (18) for forming fluid received from said storage chamber into an elongated coherent mass body (11) and for directing the fluid mass body (11)

toward the material to be broken, said barrel (19) comprising a tubular slide valve, and means responsive to a predetermined amount of the fluid being supplied to said storage chamber (18) to permit said fluid in said storage chamber (18) to be forced into said slideable barrel (19) and toward the material to be broken by the effect of said thrust load exerted on said fluid, said means responsive to a predetermined amount of fluid being supplied to said storage chamber including means coupled to and cooperating with said tubular slide valve of said barrel for controlling the admission of fluid into said barrel (19) from said storage chamber (18).

33. A device according to claim 32, wherein said means for exerting said thrust load includes a loaded piston in communication with said storage chamber, and said means cooperating with said tubular slide valve of said barrel comprises means (26) carried by said piston for engaging said tubular slide valve and being disengagable from said tubular slide valve responsive to said predetermined amount of fluid being supplied to said storage chamber to permit the admission of said fluid into said barrel.

34. A device according to claim 32, wherein said means for exerting said thrust load substantially always exerts said thrust load upon fluid in said storage chamber.

35. A device for breaking a hard compact material, such as rock, wherein the material is broken by means of relatively incompressible fluid, such as water, which as an elongated fluid mass body (11) is directed toward the material to be broken, comprising:

a storage chamber (18) for storing the fluid, a drive piston (15) slideably mounted in said storage chamber, means (16) operatively associated with said drive piston (15) and storage chamber (18) for exerting a thrust load upon the fluid in said storage chamber (18) via said drive piston (15), means for successive supply of said fluid to said storage chamber (18) against the effect of said thrust load, a barrel (19) slideably coupled to said storage chamber (18) for forming fluid received from said storage chamber into an elongated coherent mass body (11) and for directing the fluid mass body (11) toward the material to be broken, and means responsive to a predetermined amount of the fluid being supplied to said storage chamber (18) to permit said fluid in said storage chamber (18) to be forced into said barrel (19) and toward the material to be broken by the effect of said thrust load exerted on said fluid, said means responsive to a predetermined amount of fluid being supplied to said storage chamber including valve means (22,28; 43,45) on said barrel (19) for controlling the admission of fluid into said barrel (19) from said storage chamber (18), said drive piston (15) and barrel (19) being adapted to be moved together in a backward direction opposite to the working direction of said drive piston (15) during the supply of fluid to said storage chamber (18), and said drive piston (15) being provided with sealing means (26) for fluid-tight cooperation with said valve means on said barrel (19) during said simultaneous backward movement of said drive piston (15) and said barrel (19).

36. A device according to claim 35, wherein said barrel (19) comprises stop means (23) adapted to limit the backward movement of said barrel.

37. A device according to claim 36, wherein said stop means (23) is axially adjustable relative to said barrel (19) for permitting adjustment of the amount of fluid supplied to said storage chamber (18).

38. A device according to claim 35, wherein said barrel (19) is movable in the driving direction of the fluid mass body, said barrel (19) including means cooperating with the fluid in said storage chamber for hydraulically retarding said barrel (19) by the fluid in said storage chamber when said barrel is moved in the driving direction of the fluid mass body.

39. a device according to claim 10, wherein said barrel (19) comprises a tubular slide valve for controlling the admission of fluid into said barrel.

* * * * *

UNITED STATES PATENT AND TRADEMARK OFFICE

CERTIFICATE OF CORRECTION

PATENT NO. : 4,195,885

DATED : April 1, 1980

INVENTOR(S) : Erik V. LAVON

It is certified that error appears in the above-identified patent and that said Letters Patent are hereby corrected as shown below:

Column 2, line 36, change "other fluids however may be used" to --. Other fluids, however, may be used--;

Column 5, lines 64 and 65, change "Water in the mass body" to --Water in the form of an elongated mass body--;

Column 9 (claim 23), line 43, change "valve means, is of the type" to --valve means is of the seat-valve type--;

Column 10 (claim 27), line 16, change "claim 26" to --claim 25--.

Signed and Sealed this

*Twenty-fourth* Day of *June 1980*

[SEAL]

*Attest:*

SIDNEY A. DIAMOND

*Attesting Officer*

*Commissioner of Patents and Trademarks*